US008361255B2

(12) United States Patent
Takano et al.

(10) Patent No.: US 8,361,255 B2
(45) Date of Patent: Jan. 29, 2013

(54) COPPER ALLOY MATERIAL AND METHOD OF MAKING SAME

(75) Inventors: Hiroaki Takano, Tsuchiura (JP); Yoshiki Yamamoto, Tsukuba (JP); Koichi Kotoku, Inashiki-gun (JP); Chingping Tong, Tsuchiura (JP)

(73) Assignee: Hitachi Cable, Ltd., Tokyo (JP)

( * ) Notice: Subject to any disclaimer, the term of this patent is extended or adjusted under 35 U.S.C. 154(b) by 748 days.

(21) Appl. No.: 12/603,804

(22) Filed: Oct. 22, 2009

(65) Prior Publication Data

US 2010/0037996 A1 Feb. 18, 2010

Related U.S. Application Data

(62) Division of application No. 11/510,853, filed on Aug. 28, 2006, now abandoned.

(30) Foreign Application Priority Data

Sep. 2, 2005 (JP) ..... 2005-255494

(51) Int. Cl.
*C22F 1/08* (2006.01)
*C22C 9/06* (2006.01)

(52) U.S. Cl. ..... 148/554; 148/681; 148/682; 148/683

(58) Field of Classification Search ..... 148/554, 148/681, 682, 683
See application file for complete search history.

(56) References Cited

U.S. PATENT DOCUMENTS

| | | | | |
|---|---|---|---|---|
| 3,956,027 | A | 5/1976 | Parikh et al. | |
| 4,594,221 | A | 6/1986 | Caron et al. | |
| 4,656,003 | A * | 4/1987 | Miyafuji et al. | 420/473 |
| 5,322,575 | A * | 6/1994 | Endo et al. | 148/554 |
| 5,508,001 | A | 4/1996 | Suzuki et al. | |
| 7,029,760 | B2 | 4/2006 | Mori et al. | |
| 2007/0051442 | A1 | 3/2007 | Yamamoto et al. | |

FOREIGN PATENT DOCUMENTS

| | | | |
|---|---|---|---|
| CN | 1600881 | A | 3/2005 |
| EP | 0 440 548 | A2 | 8/1991 |
| JP | 2572042 | B2 | 10/1996 |
| JP | 9-209061 | A | 8/1997 |
| JP | 2977845 | B2 | 9/1999 |
| JP | 2002-266042 | A | 9/2002 |
| JP | 3407527 | B2 | 3/2003 |
| JP | 3465541 | B2 | 8/2003 |
| JP | 2005-48262 | A | 2/2005 |

* cited by examiner

*Primary Examiner* — Sikyin Ip
(74) *Attorney, Agent, or Firm* — Foley & Lardner LLP

(57) ABSTRACT

A copper alloy material having: 1.0 to 5.0 mass % of Ni; 0.2 to 1.0 mass % of Si; 1.0 to 5.0 mass % of Zn; 0.1 to 0.5 mass % of Sn; 0.003 to 0.3 mass % of P; and the balance consisting of Cu and an unavoidable impurity. The mass ratio between Ni and each of Si, Zn and Sn is to be Ni/Si=4 to 6, Zn/Ni=0.5 or more, and Sn/Ni=0.05 to 0.2.

7 Claims, 1 Drawing Sheet

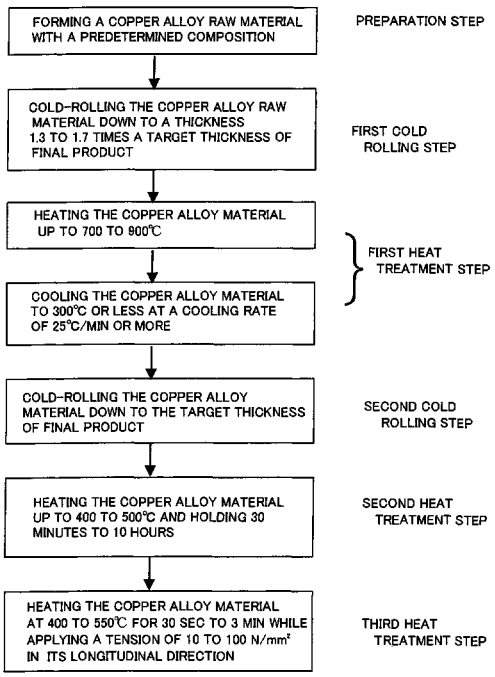

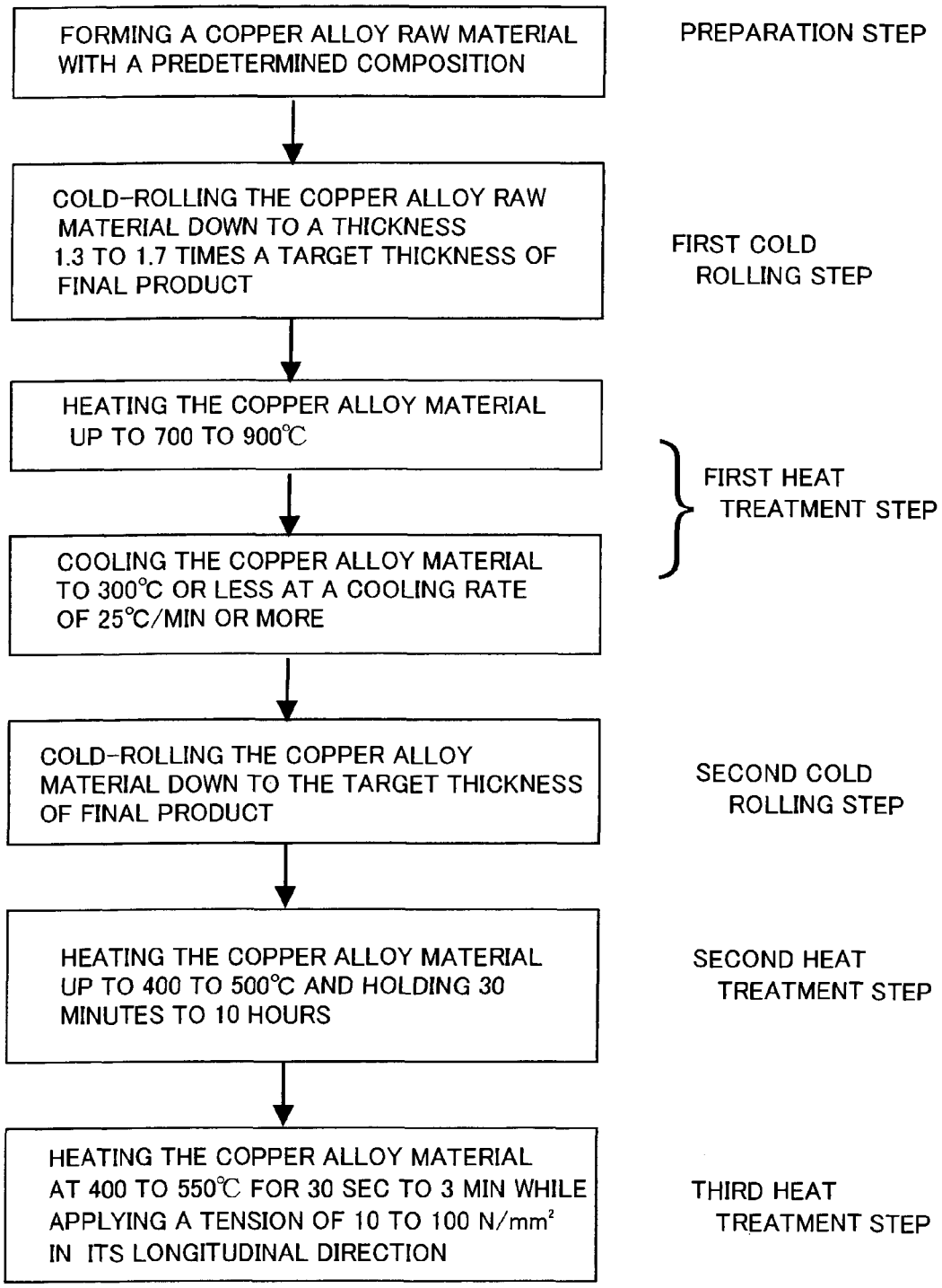
FORMING A COPPER ALLOY RAW MATERIAL WITH A PREDETERMINED COMPOSITION
PREPARATION STEP
COLD-ROLLING THE COPPER ALLOY RAW MATERIAL DOWN TO A THICKNESS 1.3 TO 1.7 TIMES A TARGET THICKNESS OF FINAL PRODUCT
FIRST COLD ROLLING STEP
HEATING THE COPPER ALLOY MATERIAL UP TO 700 TO 900℃
COOLING THE COPPER ALLOY MATERIAL TO 300℃ OR LESS AT A COOLING RATE OF 25℃/MIN OR MORE
FIRST HEAT TREATMENT STEP
COLD-ROLLING THE COPPER ALLOY MATERIAL DOWN TO THE TARGET THICKNESS OF FINAL PRODUCT
SECOND COLD ROLLING STEP
HEATING THE COPPER ALLOY MATERIAL UP TO 400 TO 500℃ AND HOLDING 30 MINUTES TO 10 HOURS
SECOND HEAT TREATMENT STEP
HEATING THE COPPER ALLOY MATERIAL AT 400 TO 550℃ FOR 30 SEC TO 3 MIN WHILE APPLYING A TENSION OF 10 TO 100 N/mm² IN ITS LONGITUDINAL DIRECTION
THIRD HEAT TREATMENT STEP

COPPER ALLOY MATERIAL AND METHOD OF MAKING SAME

CROSS-REFERENCE TO RELATED PATENT APPLICATIONS

This application is a Divisional of U.S. application Ser. No. 11/510,853, filed Aug. 28, 2006, now abandoned, which is based upon and claims the benefit of priority from prior Japanese Patent Application No. 2005-255494, filed Sep. 2, 2005, the entire contents of all of which are incorporated herein by reference in their entirety.

BACKGROUND OF THE INVENTION

1. Field of the Invention

This invention relates to a copper alloy material and, in particular, to a copper alloy material that is excellent in mechanical strength such as tensile strength and yield strength, in elongation, in electric conductivity, in bending workability, and in bonding reliability in the case of using a Pb-free solder. This invention also relates to a method of making the copper alloy material.

2. Description of the Related Art

In recent years, an electronic hardware such as a cellular phone or notebook PC is downsized, low-profiled and reduced in weight. Along with this, electric and/or electronic components used therein tend to be reduced in weight, length and thickness.

In the downsizing, although materials used therein also have to be reduced in thickness, a material is needed to have a high mechanical strength (herein also called simply "strength") even when it has the reduced thickness so as to keep a reliability in properties. Further, in order not to arise any crack in the bending process of parts, it also needs to have a good elongation. It is not suitable that the material has a difference in properties (anisotropy) between in a rolling direction and in an orthogonal direction to the rolling direction thereof, and it is important that the material has good properties in any directions.

Further, generated Joule heat increases with increasing in applied current and in the number of electrodes due to the sophistication of equipment. Thus, the material also needs to have a good electric conductivity as well as the mechanical strength. Such high electric conductivity is needed especially in a terminal and connector material for automobiles and a lead frame material for power IC, where applied current goes on increasing rapidly.

On the other hand, solder bonding is generally used for connecting and mounting the above electric and electronic parts. Although Sn—Pb eutectic system solders have been mainly used conventionally, Pb-free solders with a high Sn concentration are recently in wide use since Pb is restricted as a harmful material.

Due to the change from the Sn—Pb eutectic system solders used conventionally to the Pb-free solders, the following problems occur which have never happened before. Since most of the Pb-free solders have a higher melting point than the conventional Sn—Pb eutectic system solders, heating temperature in bonding the parts is needed to be higher than conventional one when the Pb-free solder is applied. When the heating is repeated in the process of assembling the electric and electronic parts, the interdiffusion between the Cu in the parts and the Sn in the solder is promoted at the bonding interface which is subjected to high temperature. As a result, the formation and growth of Cu—Sn intermetallic compounds at the bonding interface is promoted than before. The intermetallic compounds formed (or generated) are mainly $Cu_6Sn_5$ and $Cu_3Sn$. Since especially $Cu_3Sn$ is a brittle material, the bonding reliability will be degraded according as its growth progresses at the bonding interface.

Various copper alloys are used as materials for the electric and electronic parts. Especially copper alloys containing Cu—Ni—Si as a main component are suggested as a material to have a high mechanical strength and a high electric conductivity (e.g., JP-A-2002-266042, and JP-B-2572042, 2977845 and 3465541).

However, the Ni contained in the copper alloys has a high diffusion rate toward the solder layer and can promote the formation and growth of the intermetallic compound between the Cu and the Sn. Therefore, the intermetallic compound will be grown easily when the content of Ni increases in the above Cu—Ni—Si alloys.

Further, in the Cu—Ni—Si alloys, if it is intended to have a high strength, the bending workability deteriorates and the an isotropy in mechanical properties becomes significant. Thus, it is difficult to satisfy simultaneously these properties in the Cu—Ni—Si alloys.

SUMMARY OF THE INVENTION

It is an object of the invention to provide a copper alloy material that is excellent in mechanical strength such as tensile strength and yield strength, in elongation, in electric conductivity, and in bending workability to show reduced anisotropy in the bending process, and that can secure a stable bonding quality in the case of bonding by using a Pb-free solder.

(1) According to one aspect of the invention, a copper alloy material comprises:

1.0 to 5.0 mass % of Ni;

0.2 to 1.0 mass % of Si;

1.0 to 5.0 mass % of Zn;

0.1 to 0.5 mass % of Sn;

0.003 to 0.3 mass % of P; and the balance consisting of Cu and an unavoidable impurity, wherein a mass ratio between Ni and each of Si, Zn and Sn is to be Ni/Si=4 to 6, Zn/Ni=0.5 or more, and Sn/Ni=0.05 to 0.2.

In the above invention, the following modifications can be made.

(i) The copper alloy material comprises a tensile strength of 800 $N/mm^2$ or more.

(ii) The copper alloy material comprises an elongation of 8% or more.

(iii) The copper alloy material comprises an electric conductivity of 35% IACS or more.

(2) According to another aspect of the invention, a method of making the copper alloy material as defined in (1) comprises:

preparing a copper alloy raw material with the same composition and the same mass ratio as defined in (1);

a first cold rolling step that the copper alloy raw material is cold-rolled down to a thickness of 1.3 to 1.7 times thicker than a target thickness of a final product;

a first heat treatment step that the cold-rolled material in the first cold rolling step is heated up to 700 to 900° C. and then cooled to 300° C. or less at a cooling rate of 25° C./min or more;

a second cold rolling step that the treated material in the first heat treatment step is cold-rolled down to the target thickness;

a second heat treatment step that the cold-rolled material in the second cold rolling step is heated up to 400 to 500° C. and held for 30 min. to 10 hrs.; and a third heat treatment step that the treated material in the second heat treatment step is heated at 400 to 550° C. for 10 sec. to 3 min. while applying a tension of 10 to 100 N/mm$^2$ in its longitudinal direction.

ADVANTAGES OF THE INVENTION

A copper alloy material can be provided that is excellent in mechanical strength such as tensile strength and yield strength, in elongation, in electric conductivity, and in bending workability to show reduced anisotropy in the bending process, and that can secure a stable bonding quality in the case of bonding by using a Pb-free solder.

BRIEF DESCRIPTION OF THE DRAWINGS

The preferred embodiments according to the invention will be explained below referring to the drawings, wherein:

FIG. 1 is a flowchart showing a method of making a copper alloy material in a preferred embodiment according to the invention.

DETAILED DESCRIPTION OF THE PREFERRED EMBODIMENTS

Composition of Copper Alloy Material

Copper alloy materials of this embodiment comprise, in average composition, 1.0 to 5.0 mass % of Ni, 0.2 to 1.0 mass % of Si, 1.0 to 5.0 mass % of Zn, 0.1 to 0.5 mass % of Sn and 0.003 to 0.3 mass % of P, wherein the mass ratio between Ni and each of Si, Zn and Sn is to be Ni/Si=4 to 6, Zn/Ni=0.5 or more, and Sn/Ni=0.05 to 0.2.

The reasons for adding the alloy elements to compose the copper alloy materials and for limiting the content thereof are as follows.

The Ni can be dispersed and precipitated in the material while forming a Ni—Si compound when it is added therein together with the Si. Thereby, it can have a good electric conductivity and an enhanced strength.

If the Si is added less than 0.2 mass %, the Si compound cannot be effectively formed. If it is added more than 1.0 mass %, the electric conductivity will be badly affected. Thus, the composition of Si is defined to be 0.2 to 1.0 mass %. It is defined preferably to be 0.4 to 0.7 mass %.

The composition of Ni is needed to be 1.0 to 5.0 mass % so as to secure simultaneously a high strength and a high electric conductivity while forming the compound effectively in relation to the above composition of Si. If the content of Ni is less than the lower limit of the above Ni composition, the amount of the compound formed will be insufficient, which causes a lack of the mechanical strength. If the content of Ni is more than the upper limit thereof, the excessive Ni will be dissolved into the Cu matrix to degrade the electric conductivity and the dissolved Ni serves to promote the diffusion at the interface to the solder layer. Therefore, the growth of the Cu—Sn intermetallic compound will be promoted to degrade the bonding reliability. The composition of Ni is defined preferably to be 2.5 to 3.5 mass %.

The Zn has an effect to suppress the formation and growth of the intermetallic compound by being concentrated at the bonding interface to the solder with a function of a barrier for the interdiffusion between the Cu and the Sn. Further, it has an effect to enhance significantly the resistance of a migration phenomenon as well as enhancing the strength. The composition of Zn is needed to be 1.0 to 5.0 mass %. If the content of Zn is less than the lower limit of the above Zn composition, the effect to block the diffusion of Cu at the interface with the solder will be degraded. If the content of Zn is more than the upper limit thereof, an adverse effect such as a reduction in the electric conductivity will be caused. The composition of Zn is defined preferably to be 1.5 to 2.0 mass %.

The Sn has an effect to enhance the strength. The composition of Sn is needed to be 0.1 to 0.5 mass %. If the content of Sn is less than the lower limit thereof, the strength-enhancing effect will be degraded. If more than the upper limit thereof, an adverse effect such as a reduction in the electric conductivity will be caused and the growth of the Cu—Sn intermetallic compound will be promoted at the interface with the solder. The composition of Sn is defined preferably to be 0.2 to 0.4 mass %.

The P has an effect to serve as a deoxidizing agent. It can suppress the loss of Si due to its oxidization in the process of forming the copper alloy raw material (e.g., in the casting thereof). Also, it can contribute to enhance the strength by being dispersed and precipitated while forming a compound with Ni. If the content of P is less than 0.003 mass %, the deoxidizing effect will be insufficient. If more than 0.3 mass %, a crack may be arisen that is caused by the segregation of P compound in the process of forming the copper alloy raw material (e.g., in the casting thereof). Thus, the composition of P is defined to be 0.003 to 0.3 mass %, preferably to be 0.01 to 0.05 mass %.

In order to achieve the object of the invention, the mass ratio of Ni/Si, Zn/Ni and Sn/Ni is needed to be defined. For example, the mass ratio between Ni and each of Si, Zn and Sn is to be defined Ni/Si=4 to 6, Zn/Ni=0.5 or more, and Sn/Ni=0.05 to 0.2. It is defined preferably Ni/Si=4 to 5, Zn/Ni=0.9 or more, and Sn/Ni=0.1 to 0.17.

When the mass ratio (Ni/Si) of Ni and Si is defined as above, the strength can be enhanced by improving the dispersion of the precipitation while preventing the reduction of electric conductivity by reducing the amount of Ni and Si to remain in the Cu matrix in the solid solution state. Further, since the amount of Ni to remain in the Cu as the solid solution can be reduced, the growth of the Cu—Sn intermetallic compound at the bonding interface with the solder can be prevented that may be promoted by the diffusion of the dissolved Ni.

If the mass ratio (Ni/Si) of Ni and Si is less than 4, the excessive Si degrades the electric conductivity in forming the compound. If the mass ratio is more than 6, the excessive Ni degrades the electric conductivity and the growth of the Cu—Sn intermetallic compound will be promoted at the interface with the solder by the affect of Ni remaining in the solid solution state.

When the mass ratio (Zn/Ni) of Ni and Zn is defined as above, the Zn with an effect of suppressing the growth of the Cu—Sn intermetallic compound can be added above the predetermined ratio relative to the Ni with the affection of promoting the growth thereof. Thus, the growth of the Cu—Sn intermetallic compound can be comprehensively prevented. If the mass ratio (Zn/Ni) is less than 0.5, the effect of preventing the growth of the Cu—Sn intermetallic compound cannot be obtained sufficiently since the amount of Zn becomes insufficient at the interface with the solder.

When the mass ratio (Sn/Ni) of Ni and Sn is defined as above, the Sn can be added with its suitable amount. If the Sn is added excessively, the growth of the Cu—Sn intermetallic compound will be promoted. If it is added insufficiently, the effect of enhancing the strength will be degraded. If the mass ratio (Sn/Ni) is less than 0.05, the effect of enhancing the strength by adding Sn cannot be obtained sufficiently since the amount of Sn is small even when the amount of Ni is suitable. If the mass ratio (Sn/Ni) is more than 0.2, the growth of the Cu—Sn intermetallic compound will be promoted since the amount of Sn is large even when the amount of Ni is suitable.

Method of Making the Copper Alloy Material

FIG. 1 is a flowchart showing a method of making a copper alloy material in the preferred embodiment according to the invention.

The abovementioned copper alloy material of this embodiment can be made, after preparing a copper alloy raw material with the average composition as defined earlier, by conducting: the first cold rolling step that the copper alloy material thus formed is cold-rolled down to 1.3 to 1.7 times a target thickness of final product; the first heat treatment step that the material after the first cold rolling step is heated up to 700 to 900° C. and then cooled to less than 300° C. at a cooling rate of 25° C./min or more; the second cold rolling step that the material after the first heat treatment step is cold-rolled down to the target thickness of final product; and the second heat treatment step that the material after the second cold rolling step is heated up to 400 to 500° C. and kept for 30 minutes to 10 hours; and the third heat treatment step that the material after the second heat treatment step is kept at 400 to 550° C. for 10 sec. to 3 min. while applying a tension of 10 to 100 $N/mm^2$ in its longitudinal direction. Meanwhile, the copper alloy raw material can be, for example, prepared by conducting an alloy casting step and then a hot processing step.

First Cold Rolling Step

In the first cold rolling step, the copper alloy raw material prepared is cold-rolled down to 1.3 to 1.7 times the target thickness of final product. This process (step) promotes the recrystallization in the following first heat treatment and allows the formation of the grain structure with equalized grain size after the recrystallization. The reason why the material thickness after the rolling is defined to be 1.3 to 1.7 times the target thickness of final product is to introduce a proper amount of lattice defect such as a dislocation in the cold rolling (i.e., the second cold rolling step) after the first heat treatment step as described later. If the material thickness is more than the defined thickness, excessive lattice defects will be introduced by the cold rolling (i.e., the second cold rolling step) after the first heat treatment step and, therefore, the elongation property of the final product is lowered and the anisotropy of the elongation property is arisen depending on the rolling direction in the bending process, that causes to degrade the bending workability of the product. If the material thickness is less than the defined thickness, the lattice defect will be insufficiently introduced in the cold rolling (i.e., the second cold rolling step) after the first heat treatment step and, therefore, the mechanical strength such as tensile strength and yield strength is lowered.

First Heat Treatment Step

In the first heat treatment step, in order to carry out the solution heat treatment (solid solution heat treatment), the copper alloy material after the first cold rolling step is heated up to 700 to 900° C. and then cooled to less than 300° C. at a cooling rate of 25° C./min or more. Preferably, it is heated up to 770 to 860° C. and then cooled to less than 300° C. at a cooling rate of 150° C./min or more. Although the holding time of the heating is not defined, it is preferably shorter in consideration of the productivity and the material only has to be held at the defined temperature substantially for 1 sec. or more. The solution heat treatment in this step is intended to disperse (dissolve) uniformly the alloy component into the copper matrix so as to disperse and precipitate uniformly and finely the alloy component in the final product. Thereby, the nonuniform precipitation that may be formed in the process of preparing the copper alloy raw material can be dissolved again in the copper matrix by the solid solution heat treatment. By defining the heating temperature to be 700° C. or more, the formation of solid solution can be sufficiently progressed. By defining the cooling rate to be 25° C./min or more, a coarse precipitation (grain growth of the precipitation) can be prevented from being formed again during the cooling process.

Further, by the first heat treatment step, the grain distorted by the intensive cold working (i.e., the first cold rolling step) can be recrystallized and changed into a grain structure with reduced anisotropy, and the elongation property of the rolled material can be recovered to provide a good bending workability. If the heating temperature is more than 900° C., a coarsening of the grain (i.e., excessive recrystallization or exaggerated grain growth) may be occurred resulting in the degradation of the bending workability. Therefore, the upper limit of the heating temperature is defined to be 900° C.

Second Cold Rolling Step

In the second cold rolling step, the copper alloy material after the first heat treatment is cold-rolled until having the target thickness of final product. Thereby, the lattice defect which becomes a starting point (i.e., a nucleation site) for forming the precipitation in the heat treatment (i.e., the second heat treatment step) as described later can be introduced suitably into the material. Thus, the formation of uniform and fine precipitation can be promoted in the following heat treatment (i.e., the second heat treatment step), and the mechanical strength can be enhanced.

Second Heat Treatment Step

In the second heat treatment step, in order to achieve the age-hardening (precipitation-hardening), the copper alloy material after the second cold rolling step is heated up to 400 to 500° C. and held for 30 minutes to 10 hours. Preferably, it is heated up to 430 to 480° C. and held for 1 to 5 hours. Thereby, the Ni—Si compound can be formed, and dispersed and precipitated in the copper matrix to have simultaneously the high mechanical strength and good electric conductivity. If the treatment conditions are higher and longer than the defined range, 400 to 500° C. and 30 minutes to 10 hours, the precipitation may be coarsened to fail to have the sufficient strength. If the treatment conditions are lower and shorter than the defined range, the precipitation may be insufficiently progressed to fail to have the sufficient electric conductivity and mechanical strength.

Third Heat Treatment Step

In the third heat treatment step, the copper alloy material after the second heat treatment step is heated at 400 to 550° C. for 10 sec. to 3 min. while applying a tension of 10 to 100 $N/mm^2$. Preferably, it is heated at 450 to 500° C. for 30 sec. to 1 min. By conducting the heat treatment while applying a suitable tension, the shape of the material after the age-hardening heat treatment can be cured and the electric conductivity can be further enhanced. If the tension is less than 10 $N/mm^2$, it is not sufficient in curing the shape. If the tension is more than 100 $N/mm^2$, the material may be excessively deformed and broken. If the treatment conditions are higher and longer than the defined range, 400 to 550° C. and 10 sec. to 1 min., the precipitation may be coarsened to degrade the strength. If the treatment conditions are lower and shorter than the defined range, the curing effect of the shape by the tension cannot be obtained sufficiently and the precipitation may be insufficiently progressed to fail to enhance the electric conductivity.

EFFECTS OF THE EMBODIMENT

The effects of the embodiment are as follows.

(1) The copper alloy material can be obtained which has a tensile strength of 800 N/mm$^2$ or more, an elongation of 8% or more, an electric conductivity of 35% IACS or more, and reduced anisotropy in the bending process (i.e., good bending workability).

(2) In addition to the excellent properties as described in (1), in the case of bonding by using the Pb-free solder, the growth of the intermetallic compound between Cu and Sn formed at the interface after the solder bonding can be suppressed to prevent the embrittlement of the bonding part. Thus, the stable bonding quality can be secured.

(3) Because of the excellent properties as described in (1) and (2), electronic parts can have an expanded choice of design while it tends to be downsized all the more.

(4) Although it has the excellent properties as described in (1) and (2), it can be made for almost the same cost as the conventional ones.

EXAMPLES

Examples of the invention will be described below, but the invention is not limited by these examples.

Example 1 (=Sample No. 1)

A copper alloy which comprising Ni: 3.0 mass %, Si: 0.7 mass %, Zn: 1.7 mass %, Sn: 0.3 mass % and P: 0.02 mass % in an oxygen-free copper matrix is melted in a RF melting furnace and then cast into an ingot with a diameter of 30 mm and a length of 250 mm.

The ingot is heated to 850° C. and extruded (hot-worked) into a plate-like copper alloy raw material with a width of 20 mm and a thickness of 8 mm. Then, it is cold-rolled down to a thickness of 0.45 mm (the first cold rolling step). Then, the cold-rolled material is held at 860° C. for 1 min. and then is quenched in water to be cooled down to room temperature (20° C.) at a rate of about 300° C./min (the first heat treatment step). Then, the cooled material is cold-rolled down to a thickness of 0.3 mm (the second cold rolling step), and then heated at 450° C. for 4 hours (the second heat treatment step). Then, it is heated at 450° C. for 1 min. while applying a tension of 30 N/mm$^2$ in the longitudinal direction (the third heat treatment step) (Sample No. 1).

Sample No. 1 thus made is measured in relation to the properties of tensile strength, elongation and electric conductivity. The tensile strength and elongation are measured based on JIS Z 2241 and the electric conductivity is measured based on JIS H 0505. The measurement results are shown in Table 2.

As shown in Table 2, it is confirmed that Sample No. 1 has good properties, i.e., a tensile strength of 816 N/mm$^2$, an elongation of 10% and an electric conductivity of 38% IACA, which are suited to the object of the invention.

Then, Sample No. 1 is acid-degreased and is then soaked in molten Sn-3 mass % Ag-0.5 mass % Cu solder such that both faces thereof are coated with the solder. It is placed in a thermostat to be heated at 200° C. for 1 hour.

For the observation of a microstructure of the sample, the heated sample is embedded in resin and then cut off. In observing the cross section, a thickness of the Cu—Sn intermetallic compound layer formed at the interface between the material and the solder is measured and the existence of a defect such as a crack and/or a void in the intermetallic compound layer or at the interface is observed. The measurement/observation results are as shown in Table 2.

As shown in Table 2, it is confirmed that the intermetallic compound layer is as thin as 4 μm and the defect such as crack and/or void is not observed.

Examples 2 and 3 (=Sample Nos. 2 and 3)

Copper alloys with compositions as Sample Nos. 2 and 3 in Table 1 are cast like Example 1 (=Sample No. 1), rolled into samples with a thickness of 0.3 mm in the same processes as Example 1 (=Sample No. 1), subjected to the second and third heat treatments like Example 1 (=Sample No. 1). Sample Nos. 2 and 3 are measured in relation to the properties of tensile strength, elongation and electric conductivity like Example 1 (=Sample No. 1). Further, for Sample Nos. 2 and 3, a thickness of the Cu—Sn intermetallic compound layer after being coated with the solder and then heated is measured and the existence of defect is observed. The measurement/observation results are shown in Table 2.

As shown in Table 2, it is confirmed that Sample Nos. 2 and 3 have good properties suited to the object of the invention, and that the intermetallic compound layer thereof is as thin as 3 to 4 μm and the defect such as crack and/or void is not observed.

Comparative Examples 1 to 12 (=Sample Nos. 4 to 15)

The reasons for defining the alloy composition in the copper alloy material of the invention are described below as compared with Comparative examples 1 to 12.

Copper alloys with compositions as Sample Nos. 4 to 15 (which correspond to Comparative examples 1 to 12, respectively) in Table 1 are cast like Example 1 (=Sample No. 1), rolled into samples with a thickness of 0.3 mm in the same processes as Example 1 (=Sample No. 1), subjected to the second and third heat treatments like Example 1 (=Sample No. 1). Sample Nos. 4 to 15 obtained are measured in relation to the properties of tensile strength, elongation and electric conductivity like Example 1 (=Sample No. 1). Further, with respect to Sample Nos. 4 to 15, a thickness of the Cu—Sn intermetallic compound layer after being coated with the solder and then heated is measured and the existence of defect is observed. The measurement/observation results are shown in Table 2.

Sample Nos. 4 and 5 are out of the invention-defined range in relation to the content of Ni and Si. In Sample No. 4, the electric conductivity of the alloy deteriorates since the content of Ni and Si is too large. Further, it can be considered that the amount of Ni solid-solution in the matrix increases relatively due to the excessive content of Ni. Therefore, the intermetallic compound layer at the solder interface grows thicker. In Sample No. 5, sufficient strength cannot be obtained since the content of Ni and Si are too small.

Sample Nos. 6 and 7 are out of the invention-defined range in relation to the mass ratio of Ni and Si. In both cases that Ni is excessive (No. 7) and Si is excessive (No. 6), the electric conductivity of the alloy deteriorates and the tensile strength of the alloy is not good. Further, when Ni is excessive (No. 7), due to the solid solution of the Ni in the matrix, the intermetallic compound layer at the solder interface grows thicker.

Sample Nos. 8 to 10 are out of the invention-defined range in relation to the content of Zn or the mass ratio of Zn and Ni. When the content of Zn is too large (No. 8), the electric conductivity of the alloy deteriorates. In contrast, when the content of Zn is too small (No. 9), the Zn effect of preventing the growth of the intermetallic compound layer is insufficient so that the intermetallic compound layer at the solder interface grows thicker. In the case of Sample No. 10, the mass ratio of Zn and Ni is out of the invention-defined range so that the effect of preventing the growth of the intermetallic compound layer is insufficient as well.

Sample Nos. 11 to 14 are out of the invention-defined range in relation to the content of Sn or the mass ratio of Sn and Ni. No. 11 that the content of Sn is too small and the mass ratio to Ni is too small, and No. 13 that the mass ratio to Ni is too small are measured such that the tensile strength is a little insufficient. No. 12 that the content of Sn is too large and the mass ratio to Ni is too large is measured such that the electric conductivity of the alloy deteriorates and the intermetallic compound layer at the solder interface grows thicker. No. 14 that the mass ratio to Ni is too large is measured such that the intermetallic compound layer at the solder interface grows thicker as well.

Sample No. 15 is out of the invention-defined range in relation to the content of P. In this case, due to the excessive content of P, the electric conductivity of the alloy deteriorates and the elongation of the alloy is insufficient.

Comparative Examples 13 to 23
(=Sample Nos. 16 to 26)

The reasons for defining the conditions in the method of making the copper alloy material of the invention are described below as compared with Comparative examples 13 to 23.

Sample Nos. 16 to 26 (which correspond to Comparative examples 13 to 23, respectively) are made such that the copper alloys with the same composition as Sample No. 1 in Example 1 are processed in similar processes to Example 1, where the thickness ratio of the cold-rolled material before the first heat treatment step to the final product, the heating conditions of the first and second heat treatment steps, and the heating conditions and the applied tension of the third heat treatment step are shown in Table 3. In Sample No. 26, the final sample cannot be obtained since the material is broken in the third heat treatment by a higher applied tension. Sample Nos. 16 to 25 obtained are measured in relation to the properties of tensile strength, elongation and electric conductivity like Example 1 (=Sample No. 1).

Further, with respect to Sample Nos. 1 and 22 to 25, the amount of camber is measured so as to confirm the shape-curing effect by the third heat treatment step. The measurement is conducted such that the samples are cut into a length

TABLE 1

| Kind | | Sample No. | Composition (mass %) Ni | Si | Zn | Sn | P | Cu | Mass ratio Ni/Si | Zn/Ni | Sn/Ni |
|---|---|---|---|---|---|---|---|---|---|---|---|
| Example | 1 | 1 | 3.0 | 0.7 | 1.7 | 0.3 | 0.02 | balance | 4.3 | 0.57 | 0.10 |
| | 2 | 2 | 1.8 | 0.4 | 1.7 | 0.3 | 0.02 | balance | 4.5 | 0.94 | 0.17 |
| | 3 | 3 | 4.0 | 0.8 | 2.0 | 0.3 | 0.02 | balance | 5.0 | 0.50 | 0.08 |
| Comparative example | 1 | 4 | 6.0 | 1.5 | 3.0 | 0.3 | 0.02 | balance | 4.0 | 0.50 | 0.05 |
| | 2 | 5 | 0.6 | 0.1 | 1.0 | 0.1 | 0.02 | balance | 6.0 | 1.7 | 0.17 |
| | 3 | 6 | 1.4 | 0.7 | 1.0 | 0.2 | 0.02 | balance | 2.0 | 0.71 | 0.14 |
| | 4 | 7 | 5.0 | 0.7 | 2.5 | 0.4 | 0.02 | balance | 7.1 | 0.50 | 0.08 |
| | 5 | 8 | 3.0 | 0.7 | 7.0 | 0.3 | 0.02 | balance | 4.3 | 2.3 | 0.10 |
| | 6 | 9 | 3.0 | 0.7 | 0.5 | 0.3 | 0.02 | balance | 4.3 | 0.17 | 0.10 |
| | 7 | 10 | 3.0 | 0.7 | 1.0 | 0.3 | 0.02 | balance | 4.3 | 0.33 | 0.10 |
| | 8 | 11 | 3.0 | 0.7 | 1.7 | 0.05 | 0.02 | balance | 4.3 | 0.57 | 0.02 |
| | 9 | 12 | 3.0 | 0.7 | 1.7 | 1.0 | 0.02 | balance | 4.3 | 0.57 | 0.33 |
| | 10 | 13 | 3.0 | 0.7 | 1.7 | 0.12 | 0.02 | balance | 4.3 | 0.57 | 0.04 |
| | 11 | 14 | 1.5 | 0.3 | 1.7 | 0.4 | 0.02 | balance | 5.0 | 1.1 | 0.27 |
| | 12 | 15 | 3.0 | 0.7 | 1.7 | 0.3 | 0.4 | balance | 4.3 | 0.57 | 0.10 |

TABLE 2

| Kind | | Sample No. | Tensile strength ($N/mm^2$) | Elongation (%) | Electric conductivity (% IACS) | Thickness of compound layer (μm) | Existence of defect |
|---|---|---|---|---|---|---|---|
| Example | 1 | 1 | 816 | 10 | 38 | 4 | No |
| | 2 | 2 | 804 | 12 | 40 | 3 | No |
| | 3 | 3 | 836 | 9 | 37 | 4 | No |
| Comparative example | 1 | 4 | 824 | 8 | 27 | 12 | Yes |
| | 2 | 5 | 606 | 10 | 44 | 7 | No |
| | 3 | 6 | 610 | 10 | 30 | 6 | No |
| | 4 | 7 | 774 | 8 | 32 | 20 | Yes |
| | 5 | 8 | 820 | 9 | 32 | 3 | No |
| | 6 | 9 | 796 | 10 | 38 | 20 | Yes |
| | 7 | 10 | 804 | 10 | 39 | 14 | Yes |
| | 8 | 11 | 722 | 8 | 40 | 4 | No |
| | 9 | 12 | 818 | 8 | 32 | 18 | Yes |
| | 10 | 13 | 784 | 10 | 39 | 4 | No |
| | 11 | 14 | 776 | 10 | 36 | 12 | Yes |
| | 12 | 15 | 802 | 6 | 34 | 7 | No |

of 300 mm, and suspended and kept at rest along a vertical wall while allowing its convex face side to face the wall. Thereupon, the distance between the lower end of the sample bent upward and the wall surface is measured as an amount of camber. The measurement results of the tensile strength, elongation, electric conductivity and the results of the camber test are shown in Table 4.

Sample Nos. 16 and 17 are out of the invention-defined range in relation to the material thickness before the first heat treatment step. If the material before the first heat treatment step is too thin, the tensile strength of the alloy is insufficient. If the material before the first heat treatment step is too thick, the elongation characteristics is significantly degraded in the second cold rolling step after the first heat treatment step and, thus, the elongation of the final product is not sufficient.

Sample Nos. 18 and 19 are out of the invention-defined range in relation to the heating temperature of the first heat treatment step. If the heating temperature is too low, the tensile strength of the alloy becomes low. If the heating temperature is too high, the elongation and the electric conductivity of the alloy are insufficient.

Sample Nos. 20 and 21 are out of the invention-defined range in relation to the heating temperature of the second heat treatment step. If the heating temperature is too low, the tensile strength and the electric conductivity of the alloy are not sufficient. If the heating temperature is too high, the tensile strength of the alloy is significantly degraded.

Sample No. 22 is not subjected to the third heat treatment step. In this case, the elongation of the alloy is insufficient and large camber remains on the final product.

Sample Nos. 23 and 24 are out of the invention-defined range in relation to the heating temperature of the third heat treatment step. If the heating temperature is too low, the elongation of the alloy is insufficient and the effect of camber curing is insufficient. If the heating temperature is too high, the tensile strength and the electric conductivity of the alloy are significantly degraded.

Sample Nos. 25 and 26 are out of the invention-defined range in relation to the applied tension of the third heat treatment step. If the applied tension is too low, the effect of camber curing is insufficient while the elongation can be recovered. If the applied tension is too high, the material may be broken like Sample No. 26 during the third heat treatment step.

TABLE 4

| Kind | | Sample No. | Tensile strength ($N/mm^2$) | Elon-gation (%) | Electric conductivity (% IACS) | Amount of camber (mm) |
|---|---|---|---|---|---|---|
| Example 1 | | 1 | 816 | 10 | 38 | 2 |
| Comparative example | 13 | 16 | 766 | 12 | 36 | — |
| | 14 | 17 | 817 | 7 | 36 | — |
| | 15 | 18 | 718 | 10 | 40 | — |
| | 16 | 19 | 820 | 4 | 34 | — |
| | 17 | 20 | 770 | 10 | 32 | — |
| | 18 | 21 | 664 | 12 | 41 | — |
| | 19 | 22 | 816 | 7 | 35 | 7 |
| | 20 | 23 | 814 | 7 | 35 | 6 |
| | 21 | 24 | 762 | 12 | 34 | 2 |
| | 22 | 25 | 812 | 10 | 38 | 6 |

Although the invention has been described with respect to the specific embodiments for complete and clear disclosure, the appended claims are not to be thus limited but are to be construed as embodying all modifications and alternative constructions that may occur to one skilled in the art which fairly fall within the basic teaching herein set forth.

What is claimed is:

1. A method of making copper alloy material, comprising:

preparing a copper alloy raw material comprising:

1.0 to 5.0 mass % of Ni;

0.2 to 1.0 mass % of Si;

1.0 to 5.0 mass % of Zn;

0.1 to 0.5 mass % of Sn;

0.003 to 0.3 mass % of P; and a balance consisting of Cu and unavoidable impurities;

wherein a mass ratio between Ni and each of Si, Zn and Sn is to be Ni/Si=4 to 6, Zn/Ni=0.5 or more, and Sn/Ni=0.05 to 0.2;

conducting a first cold rolling step, wherein the copper alloy raw material is cold-rolled down to a thickness of 1.3 to 1.7 times thicker than a target thickness of a final product;

conducting a first heat treatment step, wherein the cold-rolled material in the first cold rolling step is heated to 700 to 900° C. and then cooled to 300° C. or less at a cooling rate of 25° C./min or more;

conducting a second cold rolling step, wherein the treated material in the first heat treatment step is cold-rolled down to the target thickness;

TABLE 3

| kind | | Sample No. | Thickness ratio of before-heat treatment and final product | First heat treatment heating conditions | Second heat treatment heating conditions | Third heat treatment: Heating conditions | Third heat treatment: Applied tension |
|---|---|---|---|---|---|---|---|
| Example 1 | | 1 | 1.50:1 | 860° C. × 1 min | 450° C. × 4 h | 450° C. × 1 min | 30 $N/mm^2$ |
| Comparative example | 13 | 16 | 1.17:1 | 860° C. × 1 min | 450° C. × 4 h | 450° C. × 1 min | 30 $N/mm^2$ |
| | 14 | 17 | 2.67:1 | 860° C. × 1 min | 450° C. × 4 h | 450° C. × 1 min | 30 $N/mm^2$ |
| | 15 | 18 | 1.50:1 | 550° C. × 1 min | 450° C. × 4 h | 450° C. × 1 min | 30 $N/mm^2$ |
| | 16 | 19 | 1.50:1 | 1000° C. × 1 min | 450° C. × 4 h | 450° C. × 1 min | 30 $N/mm^2$ |
| | 17 | 20 | 1.50:1 | 860° C. × 1 min | 350° C. × 4 h | 450° C. × 1 min | 30 $N/mm^2$ |
| | 18 | 21 | 1.50:1 | 860° C. × 1 min | 600° C. × 4 h | 450° C. × 1 min | 30 $N/mm^2$ |
| | 19 | 22 | 1.50:1 | 860° C. × 1 min | 450° C. × 4 h | not treated | not applied |
| | 20 | 23 | 1.50:1 | 860° C. × 1 min | 450° C. × 4 h | 350° C. × 1 min | 30 $N/mm^2$ |
| | 21 | 24 | 1.50:1 | 860° C. × 1 min | 450° C. × 4 h | 600° C. × 1 min | 30 $N/mm^2$ |
| | 22 | 25 | 1.50:1 | 860° C. × 1 min | 450° C. × 4 h | 450° C. × 1 min | 5 $N/mm^2$ |
| | 23 | 26 | 1.50:1 | 860° C. × 1 min | 450° C. × 4 h | 450° C. × 1 min | 300 $N/mm^2$ broken |

conducting a second heat treatment step, wherein the cold-rolled material in the second cold rolling step is heated to 400 to 500° C. and held for 30 min. to 10 hrs.; and conducting a third heat treatment step, wherein the treated material in the second heat treatment step is heated at 400 to 550° C. for 10 sec. to 3 min. while applying a tension of 10 to 100 $N/mm^2$ in a longitudinal direction of the treated material.

2. The method of claim 1, wherein the copper alloy material has a tensile strength of 800 $N/mm^2$ or more.

3. The method of claim 1, wherein the copper alloy material has an elongation of 8% or more.

4. The method of claim 1, wherein the copper alloy material has a conductivity of 35% IACS or more.

5. The method of claim 1, wherein the mass ratio of Ni/Si is 4.3 to 5.0.

6. The method of claim 1, wherein the copper alloy material is designed to be used together with a Pb-free solder.

7. The method of claim 1, wherein the copper alloy material is designed to be bonded by using a Pb-free solder.

* * * * *